United States Patent [19]

Schnell

[11] 4,109,475

[45] Aug. 29, 1978

[54] PILE-DRIVING RAM AND METHOD OF CONTROLLING THE SAME

[75] Inventor: Hans Günther Schnell, Hamburg, Fed. Rep. of Germany

[73] Assignee: Van Kooten B.V., Naarden, Netherlands

[21] Appl. No.: 638,268

[22] Filed: Dec. 5, 1975

[30] Foreign Application Priority Data

Dec. 10, 1974 [NL] Netherlands ..... 7416078
Dec. 10, 1974 [NL] Netherlands ..... 7416080

[51] Int. Cl.[2] ..... E02D 7/02

[52] U.S. Cl. ..... 61/53.5; 61/63; 123/46 H; 173/2

[58] Field of Search ..... 61/53.5, 63; 123/46 H, 123/46 SC, 46 R; 173/2, 11, 21

[56] References Cited

U.S. PATENT DOCUMENTS

| | | | |
|---|---|---|---|
| 3,161,184 | 12/1964 | Koftan | 123/46 H |
| 3,498,388 | 3/1970 | Jovis | 61/53.5 X |
| 3,643,638 | 2/1972 | Braun | 123/46 R |
| 3,721,095 | 3/1973 | Chelminski | 61/53.5 |

*Primary Examiner*—Dennis L. Taylor
*Attorney, Agent, or Firm*—Lewis H. Eslinger

[57] ABSTRACT

In a method of regulating the supply of driving-medium per stroke cycle to a pile-driving rammer the driving-medium supply per stroke cycle is adjusted for driving piles into the ground in the shortest time in dependence upon the value, measured by at least one scanner, of the result of at least two preceding strokes of the rammer and more in accordance with the driving-medium supply adjusted during the stroke which gave the better result.

In order to improve the energy transfer from a diesel hammer upon the pile apart from a basic fuel per combustion cycle at least one substance affecting the combustion velocity is supplied to the Diesel hammer in accordance with the pile-driving operation.

32 Claims, 19 Drawing Figures

Figure 5:
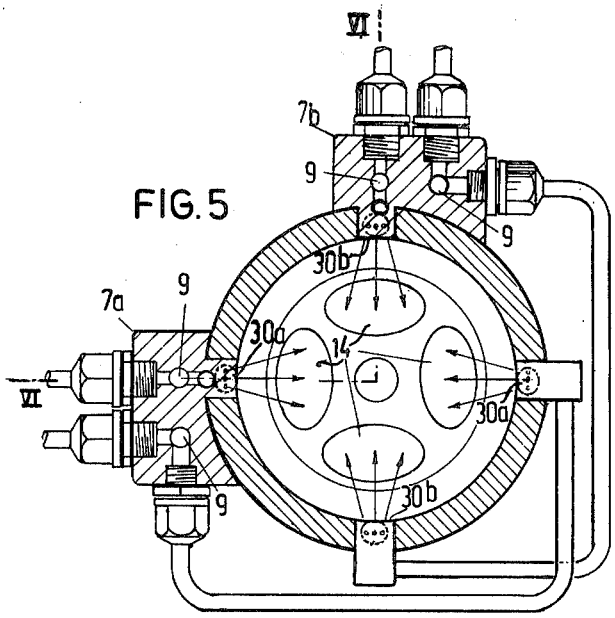

FIG.1
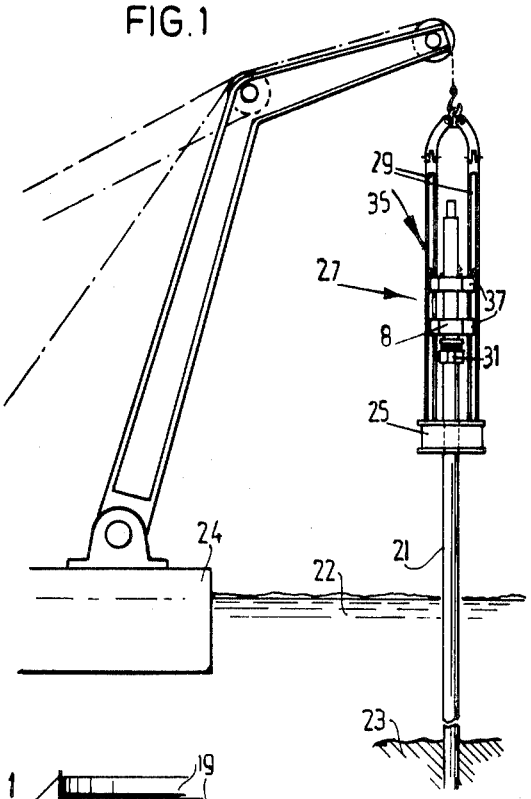
FIG.2
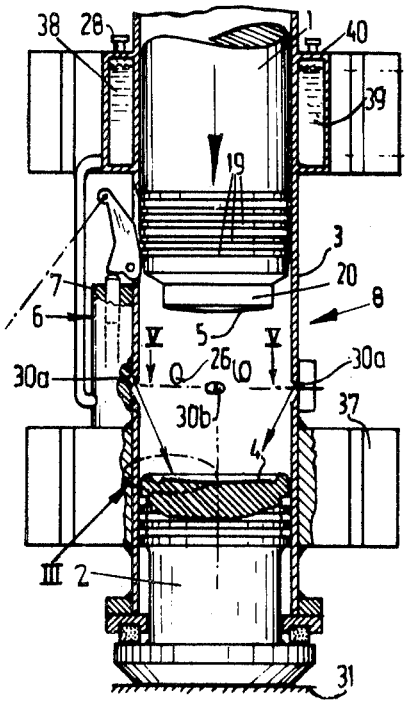
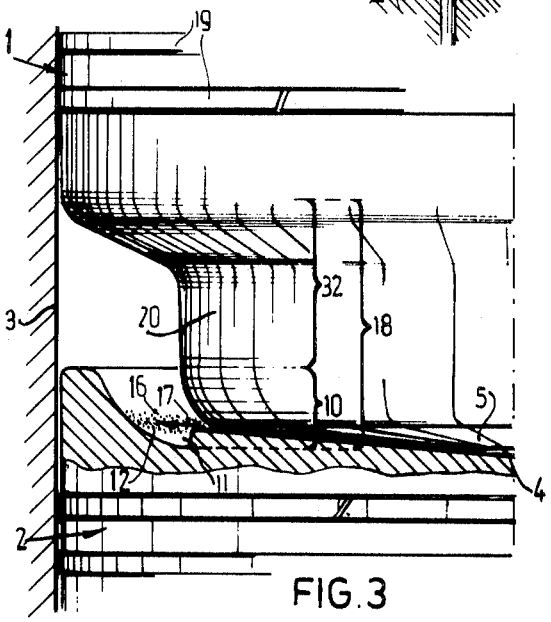
FIG.3
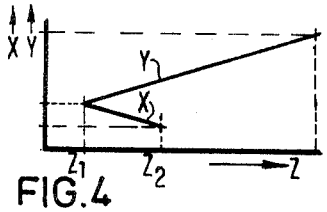
FIG.4
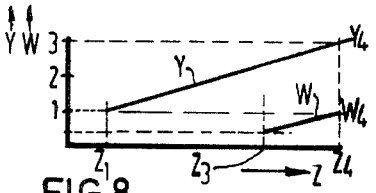
FIG.8
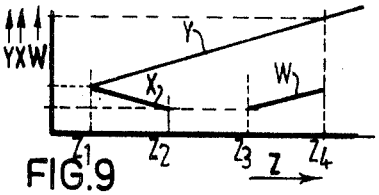
FIG.9

PILE-DRIVING RAM AND METHOD OF CONTROLLING THE SAME

The invention relates to a method of controlling the driving medium supply per stroke cycle to a pile-driving ram.

In the known method a foreman of the rammers regulates the supply of driving medium by feel, which is developed only to a reasonable extent after many years of experience. Nevertheless the foreman cannot guarantee the adjustment of the optimum conditions of the rammer because these optimum conditions depend not only on the nature, the type and the weight and the state of maintenance of the rammer but also on the properties of the pile, particularly its length and furthermore to a hardly assessable extent on the conditions of the ground, which may be different from place to place and from level to level.

The invention has for its object to provide the possibility of driving a pile into the ground within the shortest possible time. According to the invention the supply of driving medium per stroke cycle is to this end adjusted in dependence upon the value of the result of at least two preceding strokes of the rammer, measured by means of at least one scanner, and in accordance with the driving medium supply adjusted during the stroke which gave a better a result. The result of preceding strokes is the best indication for the adjustment of the driving medium supply and by automatically regulating said supply in dependence upon said result the optimum ramming conditions can be adjusted with little loss of time, even without long years of experience in ramming. Moreover, the pile-driving process can constantly be effectively adapted to the varying nature of the ground beneath the pile and to the increase in ground resistance accompanying the increase in penetration of the pile.

The invention furthermore improves a pile-driving rammer comprising at least a cylinder, an adjustable supply of a driving medium to said cylinder and a control-member for adjusting the adjustable supply, said control-member being subjected, in carrying out the method in accordance with the invention, to a scanner measuring the result of a stroke of the rammer.

In a known method of regulating the fuel supply per combustion cycle to a Diesel hammer during a pile-driving operation, said hammer comprising a combustion cylinder, a piston and a striker extending into said combustion cylinder, the fuel employed is Diesel oil, which is sprayed onto the striker. At the stroke of the piston on the striker the fuel is atomized in the direction towards a compression space surrounding the striker so that it is mixed with the air of the compression space in order to produce ignition of the fuel-air mixture. If the height of fall of the piston is small in the event of low ground resistance, the atomization of the fuel is poor as a result of which the fuel-air mixture does not ignite in due time or not at all. However, if the height of drop of the piston is great in the event of a high ground resistance, the piston tends to leave the striker prematurely. Then the transfer of energy from the ram to the pile is slight or at least not optimal. The invention has further for its object to provide an efficient operation of the ram independently of the ground resistance. According to the invention this is achieved by supplying, apart from a basic fuel, per combustion cycle at least one substance affecting the combustion velocity to the Diesel hammer in dependence upon the ramming process.

In a pile-driving operation in which there is a risk of excessively rapid combustion preferably a smaller quantity of combustion-decelerating fuel is supplied according as the risk of excessively rapid combustion decreases.

Accordingly in a pile-driving operation involving a risk of excessively slow combustion a larger quantity of combustion-accelerating fuel is supplied according as the risk of excessively slow combustion increases.

It should be noted that it is known, for example from the German Patent application No. 1,484,504 laid up for public inspection and from the British Patent Specification No. 844,027, to start a Diesel hammer by supplying thereto, as long as the Diesel hammer has not reached the required temperature, an ignition fuel, particularly ether. The use of ether with a Diesel hammer, however, is odious. The ignition and combustion of ether are much too rapid and bring about serious wear and/or damage of the Diesel hammer.

Further not a Diesel pile-driving ram but a Diesel engine is known from the German Patent application No. 2,129,365 laid up for public inspection, in which when running with a low engine speed a fuel stimulating the ignition, for example lubricating oil, is added to a fuel tending less to ignition, for example petrol having an octane number of 80–100. The addition has for its object to ensure the ignition of a Diesel engine. The problem of the present invention is choosing the velocity of the combustion of the mixture of air and of fuel atomized by stroke atomization such that the hammer jumps off from the pile-driving ram at such a moment that an efficient and preferably optimum transfer of energy from the pile-driving ram up to the pile to be driven can be expected.

The aforesaid and further features of the invention will be explained in the following description with reference to a drawing.

Figure 6:
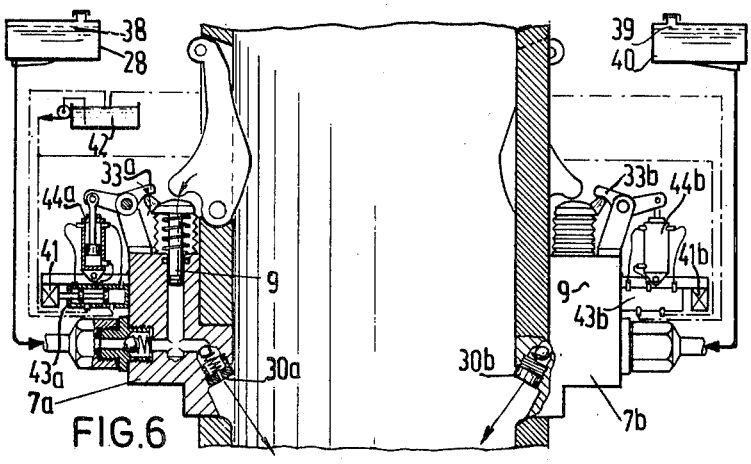
Figure 7:
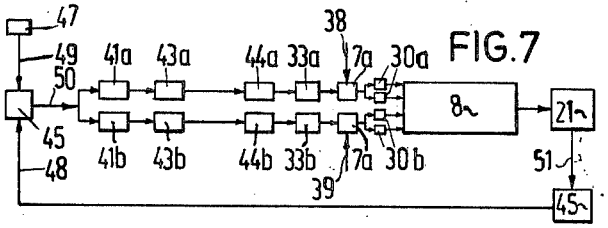
Figure 10:
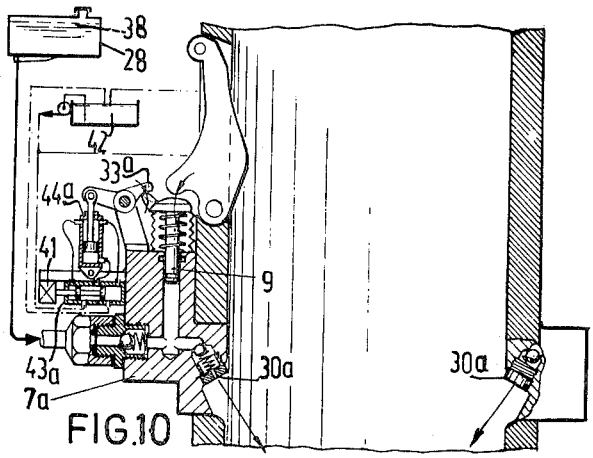
Figure 11:
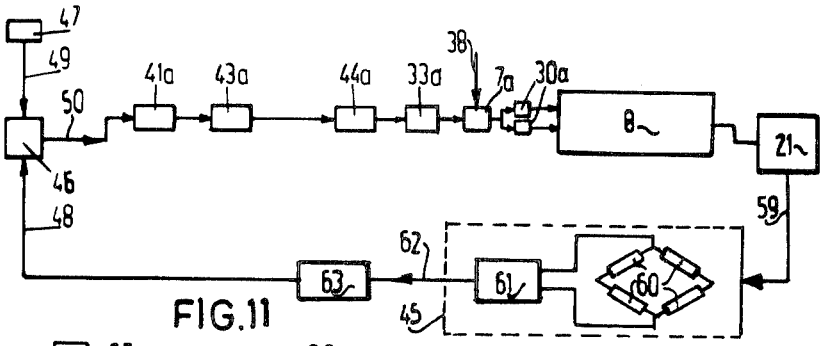
Figure 13:
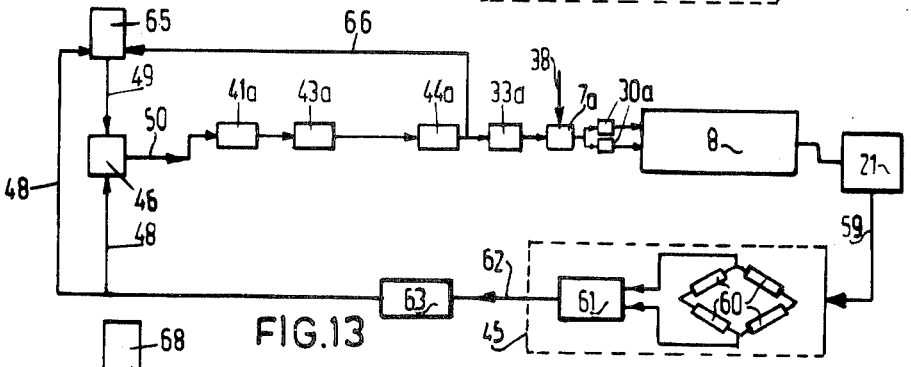
Figure 15:
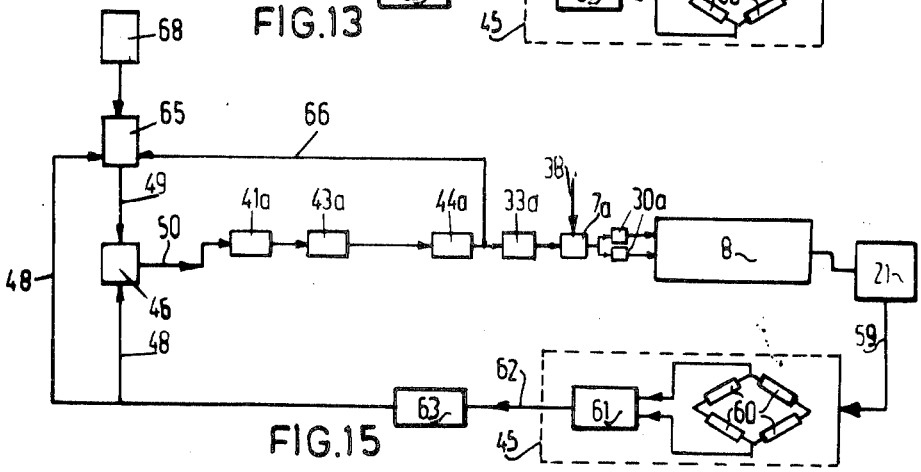
Figure 16:
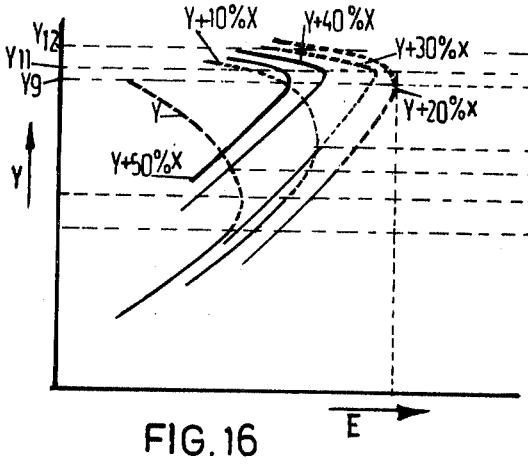
Figure 17:
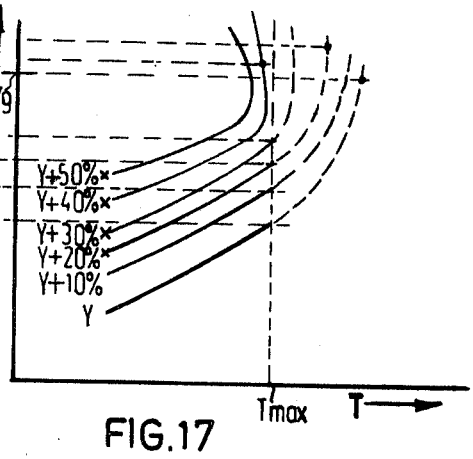
Figure 18:
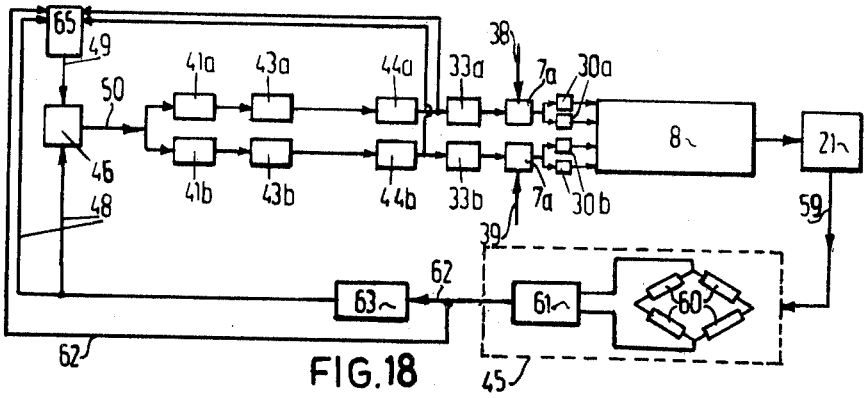
Figure 12:
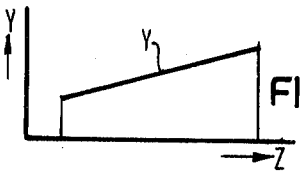
Figure 14:
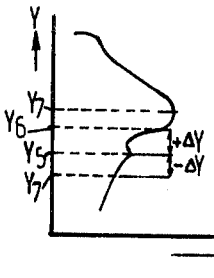

In the drawing:

FIG. 1 is a survey of the operation of a pile-driving device equipped with a rammer in accordance with the invention, FIG. 2 is an enlarged vertical sectional view of a rammer as shown in FIG. 1, FIG. 3 shows on an enlarged scale a preferred embodiment of the detail III in FIG. 2 in a different position, FIGS. 4, 8, 9 and 12 are relatively different graphs of the fuel supply in accordance with the ground resistance, FIG. 5 is an enlarged sectional view taken on the line V—V in FIG. 2, FIG. 6 is a diagram relating to the fuel injector for use with a pile-driving rammer as shown in FIG. 5 in a sectional view taken on the line VI—VI in FIG. 5, FIG. 10 is a diagram corresponding with that of FIG. 6 relating to a further fuel injector for use with a pile-driving rammer in accordance with the invention, FIGS. 7 and 11 show a control-diagram for a rammer as shown in FIGS. 5 and 10 respectively, FIG. 13 shows a control-scheme showing improvements of that of FIG. 11, FIG. 15 is a control-scheme in a further development as compared with that of FIG. 13, FIGS. 14 and 16 illustrate an example of the energy induced in a pile in accordance with the fuel supply, FIG. 17 illustrates examples of maximum stresses produced in a pile in dependence upon the fuel supply illustrated in FIG. 16, FIG. 18 is a further developed control-scheme for the pile-driving rammer shown in FIGS. 1 to 3, FIG. 19 is a stress-time diagram.

By means of a floating derrick 24 a pile-driving device 27 is arranged on a pile 21 to be driven into a ground 23 beneath the water 22. This pile-driving device 27 comprises a guide frame 35 formed by a socket 25 surrounding the pile 21 and two guide stays 29 secured thereto. The pile-driving device 27 comprises furthermore a rammer 8 guided by means of guide members 37 along the guide stays 29 and formed by a Diesel rammer and a ram cap 31 bearing on the pile 21.

FIG. 2 shows that the rammer 8 comprises a combustion cylinder 3, a piston 1 operating as a hammer therein and a striker 2 bearing on the cap 31 and extending into the combustion cylinder 3. The combustion cylinder 3 holds two tanks 28 and 40 and has ports 26 for admitting air and evacuating exhaust gases and a fuel injector 6.

The piston 1 is sealed by means of piston rings 19 with respect to the combustion cylinder 3 and has a piston head 20, which is surrounded by an annular compression chamber 18. A conical impact surface 4 of the striker 2 matches an engaging impact surface 5 of the piston 1.

The fuel injector 6 comprises two diametrically opposite nozzles 30*a* and two diametrically opposite nozzles 30*b*, which communicate with a pump 7*a* for a basic fuel 38, formed by Diesel oil, and a pump 7*b* respectively for a substance 39 affecting the combustion velocity. The pumps 7*a* and 7*b* have a separate pump cylinder 9 for each nozzle, the pump volume of which is adjusted by means of an adjustable stop 33*a* and 33*b* respectively. The positions of the stops 33*a* and 33*b* are determined by means of a control-member 41*a* and 41*b* respectively, which regulates the supply and drainage of fluid 42 through a control-slide 43*a* and 43*b* respectively for a hydraulic cylinder 44*a* and 44*b* respectively in accordance with the control-scheme of FIG. 7. At each combustion the fuel supplied to the rammer 8 results in a stroke on the pile 21. The result of the stroke is measured on the pile 21 by means of a scanner 45. This scanner 45 may be formed by an optical meter which measures the axial displacement 51 of the pile 21 resulting from each stroke. This measured value 48 may be compared as the result of a stroke in a comparator 46 with the reference value 49 prescribed by a programme 47, after which the difference signal 50 energizes the control-members 41*a* and 41*b*. The difference signals 50 result in a displacement of the stops 33*a* and 33*b*. The direction and the value of the displacements are programmed in the control-members 41*a* and 41*b*.

The substance 39, for example petrol, is supplied as an accelerator, the more so as the combustion tends to slow down. This occurs with a decrease in ground resistance. If the scanner 45 measures a large axial displacement 51, which is indicative of a low ground resistance, the pump 7*b* will feed a large quantity of combustion accelerating substance 39 to the rammer 8.

In FIG. 4 the ground resistance Z is plotted on the horizontal line and the quantity Y of the basic fuel 38 and the quantity X of the substance 39 (petrol) are plotted schematically on the vertical line. With a low ground resistance $Z_1$, for example, even one part of petrol is supplied per part of basic fuel 38. The quantity X, as shown in FIG. 4, strongly decreases according as the ground resistance increases to the value $Z_2$, after which no petrol 39 at all is supplied. The fuel is sprayed at four areas 14 distributed along the circumference of the impact surface 4 onto said surface so that four fuel zones are formed. When the piston 1 strikes the striker 2, the fuel is satisfactorily atomized and scatters in the form of a curtain 12 in the direction 17 away from the impact surface 4 into the lower part 16 of a precombustion chamber 10 of the compression chamber 18, since a shallow, annular recess 11 is provided adjacent the impact surface 4 in the striker 2. The fuel is ignited in the precombustion chamber 10 and the combustion takes place slightly later mainly in the main combustion chamber 32. This delay in the combustion process provides a material improvement in the stroke effect of the rammer 8. Owing to the fine particles the well atomized fuel readily ignites, even with a small length of the stroke of the piston 1, but the combustion is slow owing to lack of air in the precombustion chamber 10. Owing to the use of a substance accelerating the combustion under those conditions under which the combustion tends to become too slow the compression space 18 may unobjectionally be constructed so that the combustion is slowly performed, which provides an effective operation of the rammer 8 in the event of a high ground resistance. On the other hand, in accordance with the invention a rammer 8 having a compression space producing, in principle, always a rapid combustion can also provide an improved result of the stroke. If it is known beforehand that a high ground resistance has to be expected, the tank 40 will contain, instead of petrol, a substance 39 decelerating the combustion velocity, for example, benzene, which is then fed in accordance with a different programme 47 by the pump 7*b* to the rammer 8 in accordance with the increase in ground resistance.

Referring to FIG. 8 in the event of a very high ground resistance $Z_3$ the maximum quantity $Y_3$, for example, three parts of basic fuel 38 and moreover the maximum quantity $W_3$ of the combustion-decelerating substance 39, for example, one part of engine benzene are supplied. It may furthermore be imagined that the rammer 8 comprises three tanks i.e. one tank 28 for Diesel oil 38, one tank 40 for petrol 39 operating as an accelerator and one tank (not shown) for benzene, operating as a decelerator. The supply is then performed as is illustrated in FIG. 9 in the trajectory $Z_1 - Z_2$ of low ground resistance Z apart from the Diesel oil 38 a decreasing quantity of petrol is supplied as an accelerator, in the trajectory $Z_2 - Z_3$ of normal ground resistance Z, for which the rammer 8 is constructed according to the optimum design, only Diesel oil Y and in the trajectory $Z_3 - Z_4$ apart from Diesel oil 38 an increasing quantity of benzene are supplied. Reference is made to the tables of the Examples for the definition of the basic fuel 38 to be selected and of the maximum quantity of combustion-affecting substance 39 to be added.

Examples

| basic fuel | | | | maximum addition | | | | |
|---|---|---|---|---|---|---|---|---|
| number of parts | denomination | boiling temperature degrees centrigrade | igni-tion °0 C | number of parts | denomination | boiling temperature degrees centrigate | igni-tion temper-ature ° C | function |
| 1 | Diesel oil | 200–350 | 400 | 1 | heavy petrol | 100–150 | 220 | accelerator |
| 1 | Diesel oil | 200–350 | 400 | 1 | heavy petrol | 100–180 | 220 | accelerator |
| 1 | Diesel oil | 200–350 | 400 | 1 | engine petrol | 130–200 | 220 | accelerator |
| 3 | Diesel oil | 200–350 | 400 | 1 | engine benzene | 80–160 | 450 | decelerator |
| 3 | Diesel oil | 200–350 | 400 | 1 | benzene | 80 | 555 | decelerator |
| 9 | Diesel oil | 200–350 | 400 | 1 | ethanol | 78 | 425 | decelerator |
| 9 | Diesel oil | 200–350 | 400 | 1 | methanol | 65 | 455 | decelerator |
| 3 | Kerosin | 175–275 | 300 | 1 | light petrol | 70–90 | 220 | accelerator |
| 3 | Kerosin | 175–275 | 300 | 1 | normal petrol | 65–95 | 220 | accelerator |
| 3 | Kerosin | 175–275 | 300 | 1 | normal petrol | 80–100 | 220 | accelerator |
| 3 | Kerosin | 175–275 | 300 | 1 | normal petrol | 90–130 | 220 | accelerator |
| 1 | Kerosin | 175–275 | 300 | 1 | aircraft petrol | 40–180 | 400 | decelerator |

When the risk for a too rapid combustion is small, like in a cold climate, when driving piles under a large inclination angle and/or when driving piles into a ground with low resistance, in accordance with the invention Kerosin is supplied exceptionally as basic fuel, possible without further supplying any substance affecting the combustion velocity in a Diesel hammer being constructed for the combustion of Diesel oil.

The rammer 8 formed by a Diesel hammer, shown in FIGS. 10 and 11 is identical with that shown in FIGS. 5 to 7, the difference being, however, that the pump *7b* and the means coupled herewith for the supply of a combustion-affecting substance 39 are omitted so that the fuel injector 6 comprises only one pump *7a*, which communicates with a tank 28 for Diesel oil 38 and with two nozzles *30a*.

According to the control-scheme of FIG. 11 only the quantity of basic fuel 38 is regulated in dependence upon the result of a preceding stroke assessed by a scanner 45. The scanner 45 may comprise extensometers 60 arranged on the pile 21 for measuring the pressure stress 59 in the pile 21 and a stress meter 61, the output 62 of which is integrated per stroke in an integrator 63. The output of the integrator 63 is the measured value 48 of the result of the stroke concerned, since this measured value corresponds to the energy induced in the pile 21 during this stroke. The programme 47 of FIG. 11 is established in accordance with the scheme of FIG. 12.

Since the programme can be previously established with reasonable efficiency, but for an optimum effect only with difficulty, control is preferably performed in accordance with the control-scheme of FIG. 13, which is identical with that of FIG. 11, the programme 47 being, however, replaced by an operational memory and arithmetic device 65. The measured value 48 of the result of each stroke, together with a signal 66 relating to the quantity of fuel supplied for the stroke concerned, is stored in the operational memory and arithmetic unit 65, in which the measured value 48 with the associated signal 66 of the last stroke and those of preceding strokes are compared with one another for fixing a programme for the adjustment of the fuel supply. The comparison value 49 of the unit 65 is compared in the comparator 46 with the measured value 48. In this way an optimum adjustment of the fuel supply is automatically performed.

With a potential relationship illustrated in FIG. 14 between the fuel quantity Y and the energy E induced in the pile 21, the fuel supply will be adjusted to the value $Y_5$ with one and the same ground condition in accordance with the control-scheme of FIG. 13. The control-scheme of FIG. 15 differs from that of FIG. 13 only in that the operational memory and arithmetic unit 65 is subjected to a programme memory 68, which causes the unit 65 to operate in accordance with a given programme, in which after every sequence of, for example, 40 strokes two test strokes are performed with material experimental differences of the fuel supply in the opposite sense. With an adjustment $Y_5$ during a preceding stroke the fuel supply Y for the 40th or 41th stroke is varied by a value $+\Delta Y$ and $-\Delta Y$ respectively not depending upon the result of preceding strokes. The unit 65 assesses that the adjustment $Y_6$ provided a better result per stroke so that subsequently fuel has to be supplied more in accordance with the fuel adjustment $Y_6$. Then the optimum adjustment to the fuel quantity $Y_7$ is automatically achieved.

In FIG. 16 the energy E induced in a given pile 21 with a given ground resistance Z is plotted in a diagram for a supply of basic fuel 38 without a combustion-affecting substance 39 (line Y) and furthermore for an additional supply X of substance 39 of 10, 20, 30, 40 and 50% respectively.

The rammer 8 shown in FIGS. 5 and 6 is preferably controlled in accordance with the control-scheme of FIG. 18. Although, as shown in FIG. 16, the adjustment of the fuel supply to the line Y + 20% X at $Y_9$ will yield the maximum result, it is not possible to use a basic fuel supply in the quantity $Y_9$, since (see FIG. 17) it has to be ensured that the pile 21 should not be loaded in excess of the permissible stress $T_{max}$. In FIG. 17 the maximum stresses occurring during a stroke in a pile 21 are plotted again against different fuel quantities Y and X. FIG. 17 shows that it is not allowed to strike the pile 21 with a fuel supply in accordance with the broken line parts of the curves. The corresponding parts of the curves are also shown in FIG. 16 by broken lines. In the situation illustrated in FIGS. 16 and 17 the fuel supply should have a value $Y_{11}$ for the basic fuel 38 and in addition 40% of the substance 39.

According to the control-diagram of FIG. 18 the scanner 45 comprises a stress meter 61 and strain gauges 60 arranged on the pile 21, the output 62 of which is applied through the integrator 63 as a measured value 48 of the result of the stroke and directly to the operational memory and arithmetic unit 65. The unit 65 is programmed so that the fuel supply whose resultant stroke should exceed the maximum permissible stress $T_{max}$ is excluded.

In FIG. 19 the stress T in the pile 21 for one stroke is plotted against the time *t*, that is to say, the line Y for basic fuel 38 only in the quantity $Y_9$ of FIG. 16, furthermore in the quantity Y + 20% X, for example, at $Y_{12}$ of FIG. 16 and finally in the quantity of Y + 40% X at $Y_{11}$ in FIG. 16. It appears that at the lines Y and Y + 20% X the $T_{max}$ is transgressed and at the line Y + 40% X it is not transgressed.

It is an important advantage of the present invention that it is possible to use a heavier rammer than hitherto because so to say the striking force is restricted in accordance with the invention to the value permissible for the pile under conditions in which there is a risk of breakdown of the pile.

What I claim is:

1. A method of regulating the supply of fuel per stroke cycle to a pile-driving Diesel rammer, comprising the steps of measuring a parameter of the pile during each stroke of the rammer; adjusting the fuel supply per stroke according to the value of said parameter, measured during at least two preceding strokes of the rammer and more in accordance with the fuel supply adjusted during the stroke which gave the better result; said measuring step comprising measuring the value of the energy induced in the pile by a rammer stroke and integrating the measured value over time.

2. A method as claimed in claim 1, including, after a predetermined sequence of strokes, conducting at least one test stroke by varying the fuel supply independently of the measurement of preceding strokes resulting from the fuel supply adjusted during said predetermined sequence of strokes and thereafter during a subsequent predetermined sequence of strokes adjusting the fuel supply in accordance with the adjusted fuel supply associated with the measured value of the parameter of the pile during said test stroke which most nearly produces a desired predetermined result.

3. A method as claimed in claim 2, wherein after each predetermined sequence of strokes at least two test strokes are conducted with opposite variations of the fuel supply.

4. A method as claimed in claim 1, including the step of automatically controlling the quantity of fuel supplied per stroke cycle to a Diesel hammer.

5. A method as claimed in claim 1, including the steps of supplying, in addition to said fuel, during each stroke cycle a substance affecting the combustion velocity of the Diesel hammer, and automatically controlling the supply of said substance affecting combustion according to the value of said parameter measured during at least two preceding strokes of the rammer and more in accordance with the fuel supply adjusted during the strokes which gave the better result.

6. A method as claimed in claim 5, wherein both the quantity of basic fuel and the quantity of substance affecting the combustion velocity supplied per stroke cycle to the Diesel hammer are automatically controlled.

7. A method as claimed in claim 1, wherein said step of adjusting the fuel supply is performed in response to a predetermined programme chosen for a given pile and in accordance with stresses measured in the pile.

8. A method of regulating, during a pile driving process, the fuel supply per combustion cycle to a Diesel rammer during its continuous driving operation comprising the steps of supplying a basic fuel and at least one substance affecting the combustion velocity during combustion cycles to the Diesel hammer after the starting ignition of the hammer and completion of the starting cycle thereof.

9. A method as claimed in claim 8, wherein the step of supplying a substance affecting the combustion velocity comprises supplying a fuel decelerating the combustion.

10. A method as claimed in claim 8, wherein the step of supplying a substance affecting the combustion velocity comprises supplying a fuel accelerating the combustion.

11. A method of regulating, during a pile driving process, the fuel supply per combustion cycle to a Diesel rammer comprising the steps of supplying a basic fuel and at least one substance affecting the combustion velocity during combustion cycles to the Diesel hammer after starting the hammer; said step of supplying a substance affecting the combustion velocity comprising the step of supplying a greater or smaller quantity of fuel decelerating the combustion or a greater or smaller quantity of fuel accelerating the combustion to the Diesel hammer in accordance with the pile driving operation.

12. A method of regulating, during a pile driving process, the fuel supply per combustion cycle to a Diesel rammer comprising the steps of supplying a basic fuel and at least one substance affecting the combustion velocity during combustion cycles to the Diesel hammer after starting the hammer, wherein when in a pile-driving operation involving the risk of excessively rapid combustion, said supplying step comprises supplying a smaller quantity of combustion-decelerating substance as the risk of excessively rapid combustion decreases.

13. A method as claimed in claim 11, wherein when, in a pile-driving operating in which substantially the desired combustion velocity is attained, said supplying step comprises supplying only the basic fuel to the Diesel hammer.

14. A method as claimed in claim 11, wherein said supplying step comprises supplying one part of Diesel oil to one part of heavy petrol added as an accelerator.

15. A method as claimed in claim 11, wherein said supplying step comprises supplying one part of Diesel oil to one part of engine petrol added as an accelerator.

16. A method as claimed in claim 11, wherein said supplying step comprises supplying from three parts of Diesel oil and up to one part of engine benzene added as a decelerator.

17. A method as claimed in claim 11, wherein said supplying step comprises supplying three parts of diesel oil and up to one part of benzene added as an accelerator.

18. A method as claimed in claim 11, wherein said supplying step comprises supplying nine parts of Diesel oil and up to one part of ethanol added as a decelerator.

19. A method as claimed in claim 11, wherein said supplying step comprises supplying nine parts of Diesel oil and up to one part of methanol suppled as a decelerator.

20. A method as claimed in claim 11, wherein said supplying step comprises supplying three parts of kerosin and up to one part of light petrol supplied as an accelerator.

21. A method as claimed in claim 11, wherein said supplying step comprises supplying three parts of kerosin and up to one part of normal petrol supplied as an accelerator.

22. A method as claimed in claim 11, wherein said supplying step comprisines supplying one part of kerosin and up to one part of aircraft petrol supplied as a decelerator.

23. A method of regulating, during a pile driving process, the fuel supply per combustion cycle to a Diesel rammer comprising the steps of supplying a basic fuel and at least one substance affecting the combustion velocity during combustion cycles to the Diesel hammer after starting the hammer; wherein when in a pile-driving operation involving the risk of an excessively slow combustion, said supplying step comprises supplying a greater quantity of combustion-accelerating substance as the risk of excessively slow combustion increases.

24. A Diesel rammer for driving a pile into the ground comprising:

a cylinder including a piston slidably positioned therein;

at least one fuel supplying means for suppling fuel to said cylinder;

control means for regulating said fuel supply including an output connected to said fuel supply means;

measuring means for measuring energy induced into said pile, said measuring means including an integrator means for integrating the energy induced per stroke of the Diesel rammer, said integrator having an output;

at least one memory means connected to said output of said integrator means and to said output of said control member;

and comparator means connected to said memory means, to said output of said integrator means and to said output of said control means, for comparing the results of at least two hammer strokes and their respective adjustments of the fuel supply, said comparator having an output providing an output signal for affecting said fuel supply.

25. A Diesel rammer as claimed in claim 24 including program memory means operatively connected to said control means for varying the control-value.

26. A Diesel rammer as claimed in claim 25, wherein said program memory means varies the control means in two opposite senses during two consecutive strokes.

27. A Diesel rammer as claimed in claim 24 wherein the control means include means for adjusting the quantity of fuel supplied per stroke cycle.

28. A Diesel rammer as claimed in claim 24 comprising at least one fuel supply for basic fuel and at least one fuel supply for a substance affecting the combustion velocity, and wherein the control means adjusts the quantity of said substance supplied per stroke cycle.

29. A Diesel rammer as claimed in claim 28, wherein the control means adjusts both the quantity of basic fuel and the quantity of substance affecting the combustion velocity supplied per stroke cycle.

30. A Diesel rammer as claimed in claim 24 wherein at least one control-programme selected for a given pile and acting upon the control means is provided.

31. A Diesel rammer as claimed in claim 24 including scanner means for measuring the distance covered by the pile per stroke operatively connected to said control means.

32. A Diesel rammer as claimed in claim 24, including scanner means for measuring the stresses in the pile and operatively connected to said control means such that the maximum permissible stress in the pile is not exceeded.

* * * * *